US006539850B1

(12) United States Patent
Parker

(10) Patent No.: US 6,539,850 B1
(45) Date of Patent: Apr. 1, 2003

(54) TIRE COMPACTING APPARATUS AND METHOD OF EMPLOYING THE SAME

(76) Inventor: Hugh M. Parker, 718 Cherokee St., Talladega, AL (US) 35160

( * ) Notice: Subject to any disclaimer, the term of this patent is extended or adjusted under 35 U.S.C. 154(b) by 0 days.

(21) Appl. No.: 10/146,563

(22) Filed: May 15, 2002

(51) Int. Cl.[7] ..... B65B 13/02; B65B 13/28

(52) U.S. Cl. ..... 100/3; 100/5; 100/31

(58) Field of Search ..... 100/1, 2, 3, 5, 100/31, 76, 78, 122; 72/299; 68/243

(56) References Cited

U.S. PATENT DOCUMENTS

| | | | | |
|---|---|---|---|---|
| 1,943,755 A | * | 1/1934 | Cantwell | 68/243 |
| 3,040,655 A | * | 6/1962 | Byars | 100/122 |
| 4,171,634 A | * | 10/1979 | Perkins | 72/299 |
| 4,498,516 A | | 2/1985 | Parker | |
| 4,694,716 A | | 9/1987 | Sakamoto | |
| 4,976,178 A | | 12/1990 | Barclay | |
| 5,238,325 A | | 8/1993 | Krenzler | |
| 5,321,931 A | | 6/1994 | Bluteau | |
| 5,452,670 A | | 9/1995 | Towne | |
| 5,590,594 A | | 1/1997 | Pederson | |
| 6,098,531 A | | 8/2000 | Reinert, Sr. | |
| 6,315,223 B1 | | 11/2001 | Reinert | |

* cited by examiner

*Primary Examiner*—Allen Ostrager
*Assistant Examiner*—Jimmy T Nguyen
(74) *Attorney, Agent, or Firm*—Smith, Gambrell & Russell, LLP

(57) ABSTRACT

A tire compacting apparatus to compress a conventional tire includes a modular frame upon which a rotating apparatus and a gripping apparatus are attached. The rotating apparatus is mounted to the proximal side of the frame and includes a servomotor having a drive shaft. The drive shaft is connected to a proximal clamp which initially engages the sidewalls of the tire. The gripping apparatus is attached to the distal side of the frame and includes an actuator with a piston. The piston is connected to a distal clamp that grips the sidewalls of the tire opposite the proximal clamp. Once the distal clamp has engaged the tire, the servomotor of tire rotating apparatus will be set in motion, such that the drive shaft will begin rotation in the desired direction. The rotation of the drive shaft will cause rotation of the proximal clamp. Since the distal clamp is kept substantially rigid, the tire will be coiled about the central axis, and a series of locking belts will be affixed around the compacted tire to ease transport and disposal of the tire.

20 Claims, 8 Drawing Sheets

TIRE COMPACTING APPARATUS AND METHOD OF EMPLOYING THE SAME

FIELD OF THE INVENTION

The present invention relates to an apparatus and method for modifying tire configurations for preparing tires for storage, for transport, and for disposal, and more specifically, to an apparatus for stretching and twisting tires into a smaller compound that facilitates storage, transport, and disposal of the compacted tires.

BACKGROUND OF THE INVENTION

It is well known that the disposal of conventional vehicular tires provides an environmental and aesthetic dilemma. Dumped tires are an eyesore in the landscape, and they can create environmental hazards. Many pests—mosquitoes primarily—breed in stagnant water that collects inside the tires. Several varieties of mosquitoes can carry deadly diseases, including encephalitis. Another major threat to our health and our environment is tire fires. They are difficult to put out, so they can burn for long periods of time. Huge, thick clouds of black smoke and oily residue from burning tires can cause contamination and discomfort.

Moreover, burying conventional tires is not satisfactory, as buried tires may rise to the surface of the soil. Presently, tires are disposed of in above-ground dumps, but this is not a satisfactory solution. It creates a large mound of tires, which becomes a hazard if a fire is ignited. Burning tires will release dangerous pollutants and are difficult to extinguish.

Environmentally, disposal of such tires provides a significant problem since tires are generally made of a synthesized rubber that does not decompose when disposed. Moreover, conventional tires generally weigh between 10 and 75 pounds and are very bulky, thus making such tires difficult to manage. Tires in the conventional shape have less bulk density than other waste items, and as a result they tend to rise to the top of landfills. The annual quantity of tires disposed averages one tire for each person in the country. The volume of space required to store the tire would be greatly reduced with a compacted tire. Since space is a premium for a tire dealer, by compacting the faulty tires for storage until they are picked up for disposition would greatly improve their available floor space.

Various solutions have been ascertained to provide for the proper disposal of tires. One solution is to use tires to make a variety of items. For example, rubber modified asphalt (RMA), a by-product of scrap tires, can be used for running track and road construction. In addition, scrap tires can be processed into chips for use in industrial boilers and in alternative playground bases as a floor surface.

What is desired, then, and not found in the prior art, is a tire compacting apparatus that is able to minimize the size of tires for disposal to allow the tires to be discharged.

SUMMARY OF THE INVENTION

An object of the present invention is to provide an apparatus for compacting tires.

A further object of the present invention is to provide an apparatus to securely hold a compacted tire.

An additional object of the present invention is to provide a means for securing a compacted tire in the compacted position.

Yet another object of the present invention is to provide an apparatus for preparing a tire to be compacted.

A further object of the present invention is to provide a means for compressing a tire to aid in the handling and disposal of the tire.

The tire compacting apparatus of the present invention will compress a conventional tire, which will facilitate simple removal or destruction of the tire. The tire compacting apparatus includes a modular frame upon which a tire rotating apparatus and a tire gripping apparatus are attached. The tire rotating apparatus is mounted to the proximal side of the frame, and includes a servomotor or other driving means (such as a hand crank) having a drive shaft that is preferably connected to a drive assembly. The drive shaft is connected to a proximal tire clamp that is used to engage the sidewalls of the tire. In particular, the proximal tire clamp will securely grip and even penetrate the sidewalls of the tire such that the tire will move only pursuant to the movement of the proximal tire clamp. The clamps will be able to adjust to engage varying-sized tires, and the tension on the clamps will be mechanical, such as by a threaded screw-rod, by spring-loaded clamps, or by a hydraulic or pneumatic cylinder connected to one of the clamps.

The tire gripping apparatus is attached to the distal side of the frame. The tire gripping apparatus preferably includes an actuator, such as a hydraulic cylinder or a pneumatic cylinder, that has a piston, although other embodiments may be included such as an electric screw or a mechanical apparatus that has the ability to adjust to the diameter of the tire. The position of the actuator is maintained using a support brace that is connected between the actuator and the distal side of the frame. The piston is connected to a clamp rod, which is slidably mounted to the distal side of the frame via a set of bearings. The end of the clamp rod opposite the actuator is connected to a distal tire clamp that will securely grip and even penetrate the sidewalls of the tire opposite the proximal tire clamp. It should further be noted that although the preferred embodiment of the tire clamp is a conventional claw or clamp, other means for providing a secure and locked connection with the tire, such as a hook or chain, may be incorporated into the present design. Such embodiments must simply hold and control the tire in a secure fashion. Once the distal tire clamp has engaged the tire, the operator will be able to compress the tire as desired.

In particular, the proximal tire clamp and the distal tire clamp will engage opposite sidewalls of the tire. The piston will extend from the actuator so that the distal tire clamp will be able to engage the tire. The piston will thereby retract into the actuator such that the tire will be stretched along a central axis to allow the tire compacting apparatus to compact the tire more simply.

Once the tire has been secured by the tire gripping apparatus, the tire rotating apparatus will begin the compaction process of the tire. More specifically, the servomotor will be set in motion, such that the drive shaft will begin rotation in the desired direction. The rotation of the drive shaft will cause further rotation of the extension shaft and the proximal tire clamp. Since the distal tire clamp is kept substantially rigid and motionless, the tire will be coiled about the central axis.

These and other objects and advantages of the invention will become apparent from the following detailed description of the preferred embodiment of the adjustable insulation apparatus.

BRIEF DESCRIPTION OF THE DRAWINGS

A tire compacting apparatus embodying the features of the present invention is depicted in the accompanying drawings which form a portion of this disclosure and wherein.

DESCRIPTION OF THE PREFERRED EMBODIMENT

Figure 1:
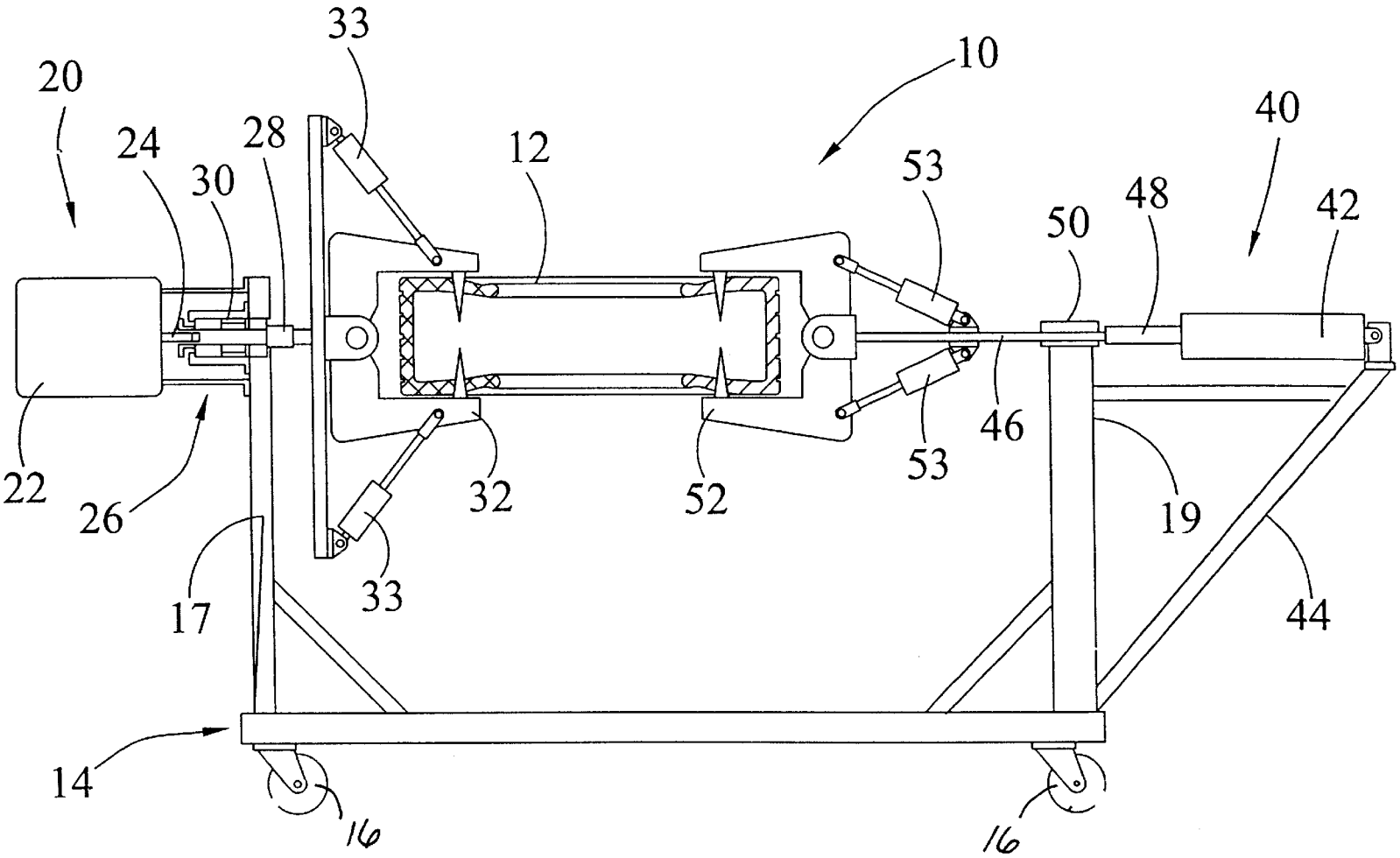
FIG. 1 is a side elevational view of the preferred embodiment of the tire compacting apparatus of the present invention.

Looking now to FIGS. 1 through 4, the preferred embodiment for the present invention of a tire compacting apparatus 10 is illustrated. The tire compacting apparatus 10 operates to compress a tire 12 to facilitate simple removal or destruction of the tire 12. The tire compacting apparatus 10 of the present design includes a modular frame 14 upon which a tire rotating apparatus 20 and a tire gripping apparatus 40 are attached. The frame 14 is preferably positioned on lockable wheels 16, with the frame 14 including a proximal side 17 and a distal side 19.

Continuing to view FIGS. 1 through 4, the tire rotating apparatus 20 is mounted to the proximal side 17 of the frame 14. The tire rotating apparatus 20 preferably includes a servomotor 22 having a drive shaft 24 that is preferably connected to a drive assembly 26 that includes an extension shaft 28 and bearings 30. The extension shaft 28 is additionally connected to a proximal tire clamp 32, or rotatable clamp, that is used to engage the sidewalls of the tire 12. In particular, the proximal tire clamp 32 will securely grip and even penetrate the sidewalls of the tire 12 such that the tire 12 will move only pursuant to the movement of the proximal tire clamp 32. It should further be noted that although the preferred embodiment of the invention is a clamp or claw, other means for providing a secure and locked connection with a tire 12, such as a hook or chain through the center of the tire, may be incorporated into the present design to securely hold and control the tire 12.

The tire gripping apparatus 40 is additionally shown attached to the distal side 19 of the frame 14. The tire gripping apparatus 40 includes an actuator 42, such as a hydraulic cylinder or a pneumatic cylinder, that has a piston 48. The position of the actuator 42 is maintained using a support brace 44 that is connected between the actuator and the distal side 19 of the frame 14. The piston 48 is connected to a clamp rod 46, which is slidably mounted to the distal side 19 of the frame 14 via a set of bearings 50. The end of the clamp rod 46 opposite the actuator 42 is connected to a distal tire clamp 52, or a static clamp, that will securely grip and even penetrate the sidewalls of the tire 12 opposite the proximal tire clamp 32. It should further be noted that although the preferred embodiment of the tire clamp 32 is a conventional claw or clamp, other means for providing a secure and locked connection with the tire 12, such as a hook or chain, may be incorporated into the present design. Such embodiments must simply hold and control the tire 12 in a secure fashion. Once the distal tire clamp 52 has engaged the tire 12, the operator will be able to compress the tire 12 as desired.

Figure 8:
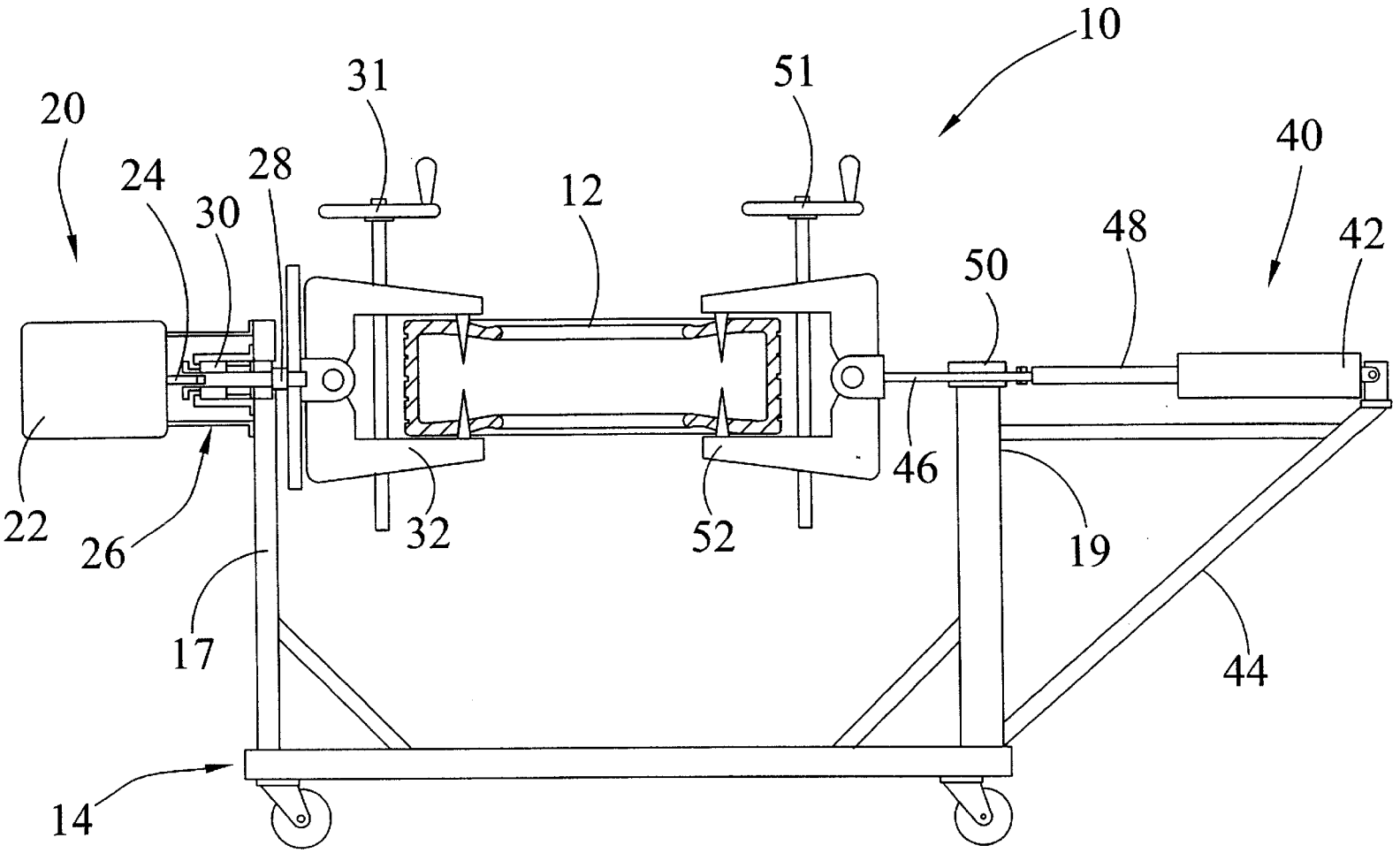
FIG. 8 is a side elevational view of the tire compacting apparatus as illustrated in FIG. 1, with the figure illustrating another means for engaging the tire with the clamp.

In particular, in the preferred embodiment, the proximal tire clamp 32 and the distal tire clamp 52 will engage opposite sidewalls of the tire 12. This engagement of the proximal tire clamp 32 with the tire 12 can be done in many ways. For example, the embodiment shown in FIG. 1 illustrates the use of a pair of proximal actuators 33, such as pneumatic or hydraulic actuators, that cooperatively open and close the clamp to engage the tire 12. However, in FIG. 8, the use of a proximal screw 31 is illustrated. In any case, the proximal tire clamp 32 will engage and hold the tire 12 first. The piston 48 will then extend from the actuator 42 so that the distal tire clamp 52 will be able to engage the opposing side of the tire 12. By incorporating the actuator 42 into the design, the user will be able to engage and hold any tire 12, irregardless of the diameter of the tire 12. The distal tire clamp 52 engages the tire 12 in the same manner as the proximal tire clamp 32. In particular, a pair of distal actuators 53 (see FIG. 1) or distal screw 51 (see FIG. 8) are used to open the distal tire clamp 52 to engage the tire 12.

Figure 2:
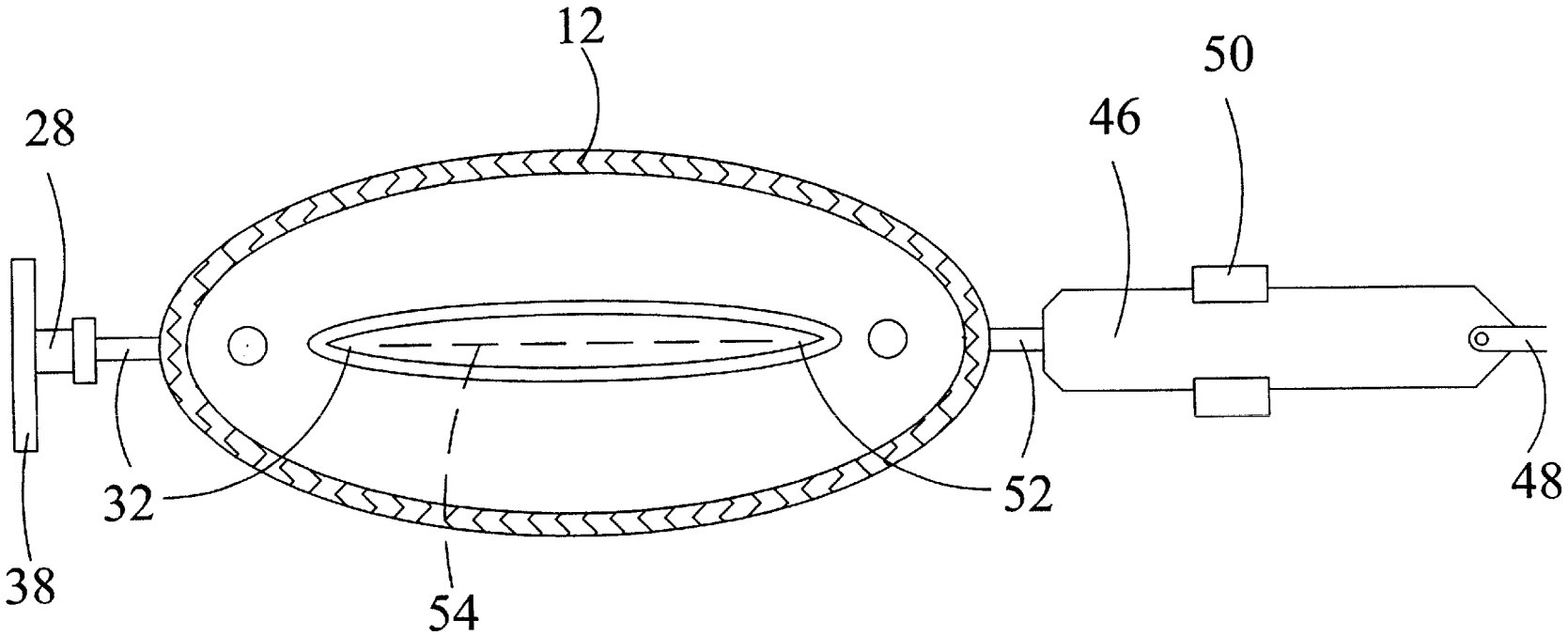
FIG. 2 is a top plan view of the tire compacting apparatus of the present invention showing the tire being stretched by the apparatus.
Figure 3:
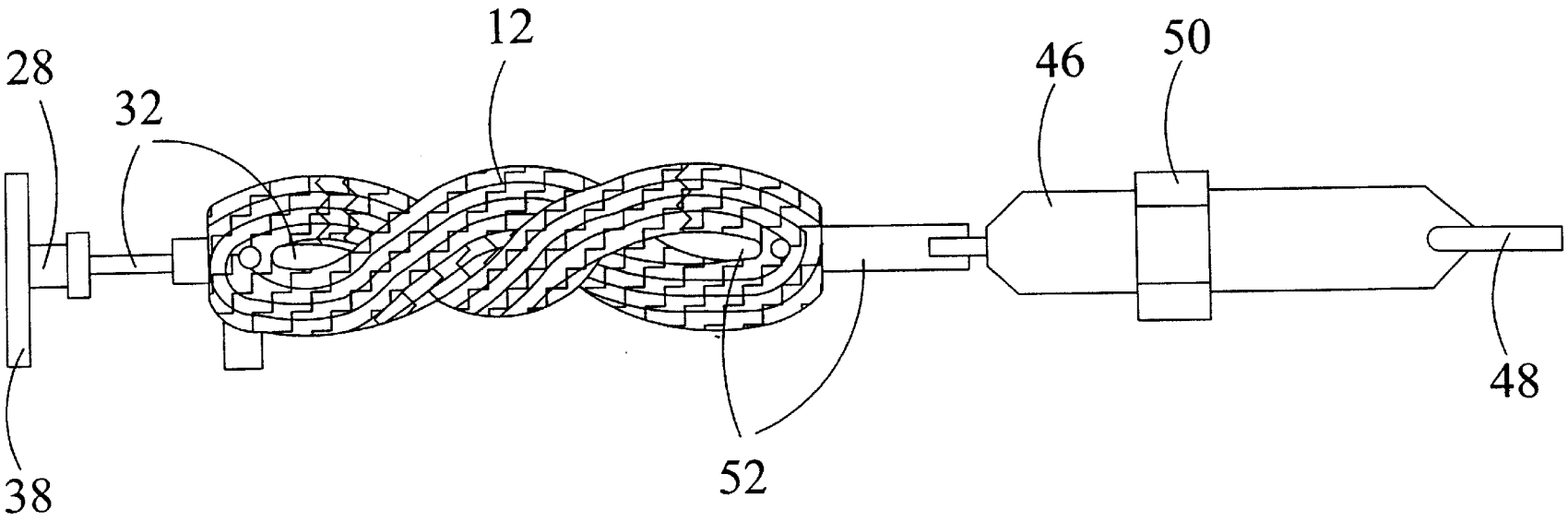
FIG. 3 is a top plan view of the tire compacting apparatus of the present invention as illustrated in FIG. 1, with the figure illustrating a twisted tire.

Once the tire 12 has been engaged by both the proximal tire clamp 32 and the distal tire clamp 52, the tire rotating apparatus 20 will begin the compaction process of the tire 12. More specifically, the servomotor 22 will be set in motion, such that the drive shaft 24 will begin rotation in the desired direction. The rotation of the drive shaft 24 will cause further rotation of the extension shaft 28 and the proximal tire clamp 32. Since the distal tire clamp 52 is kept substantially rigid and motionless, the tire 12 will be coiled about the central axis 54, as shown in FIGS. 2 and 3.

Figure 4:
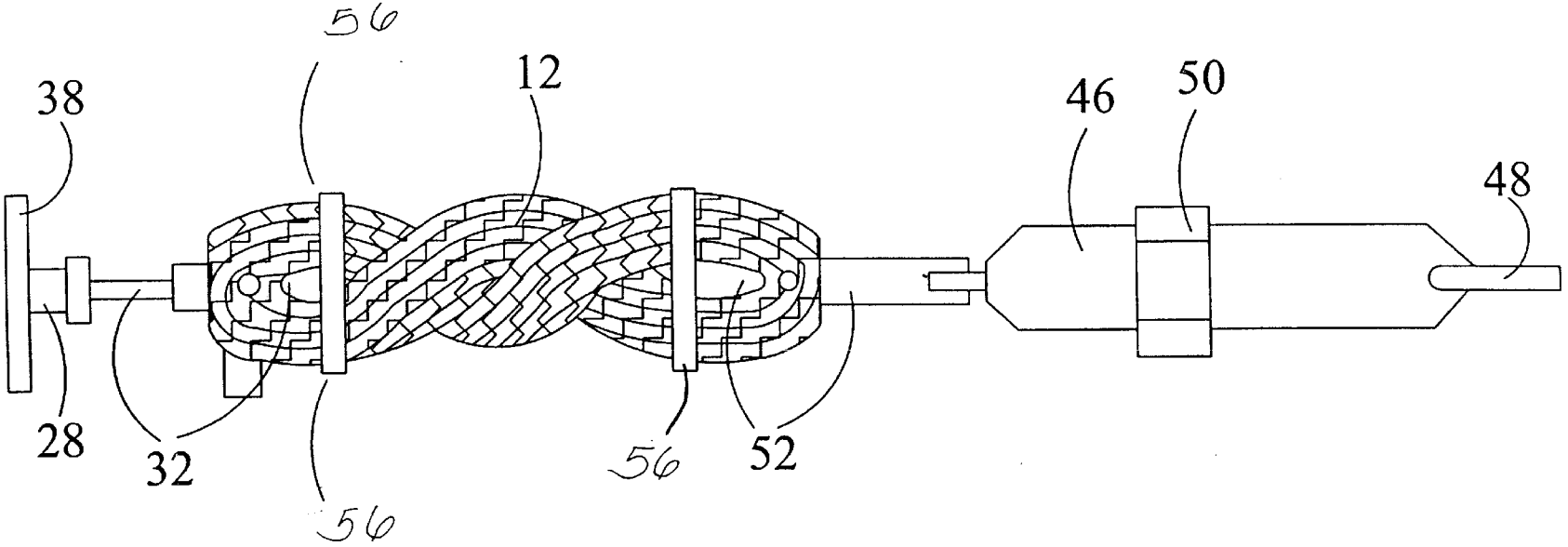
FIG. 4 is a top plan view of the tire compacting apparatus of the present invention as illustrated in FIG. 1, with the figure illustrating a twisted tire bound by cords.

Looking to FIG. 4, after the tire 12 has been plaited in the tire compacting apparatus 10, the operator will have the opportunity to secure the coiled position of the tire 12. In particular, the operator will fasten at least one locking belt 56 around the tire 12 to prevent the tire 12 from attempting to return to the original position. However, in the preferred embodiment, at least two or three belts 56 are incorporated to assure that the tire 12 remains compacted. The locking belts 56 can be any type of belt that can be secured tightly around the compressed tire 12, including embodiments incorporating a fabric belt, a metal belt, or a rubber belt. The locking belt 56 will secure the compressed tire 12 in a substantially cylinder-shaped position, such that the compressed tire 12 is more easily transported by the operator than the conventional tire used in commerce. This shape also allows the operator to develop new ways to use the tire 12 in recycling processes and recycled items.

It should also be noted that one embodiment of the present invention allows the operator to stretch the tire 12 after the proximal tire clamp 32 and the distal tire clamp 52 have engaged the tire 12. More specifically, once the distal tire clamp 52 has engaged the tire 12, the piston 48 will thereby retract into the actuator 42 such that the tire 12 will be stretched along a central axis 54, thereby altering the shape of the tire 12 from substantially circular to an ovular configuration (as shown in FIG. 2). This ovular configuration may vary due to the construction of the tire 12 to give a uniform desired result. Although not required to compact a tire 12, the process of stretching the tire 12 prior to compacting the tire 12 will allow the tire compacting apparatus 10 to twist and compact the tire 12 more easily.

The tire compacting apparatus 10 acts to reduce the bulkiness of a tire 12 by then twisting the tire 12 around a central axis 54 such that the outer edges of the tire 12 are brought together. When such torque is applied to the tire 12, or any other material for that matter, a field of equal perpendicular tensile and compressive stresses is created. The tire 12 will distort (and fail with enough torque) in either tension or compression, depending upon the material's physical properties. Furthermore, this failure mode will approach a 45 degree angle with its centerline. A reinforced rubber tire 12 is much stronger in tension than in compression. As a result, it will begin to fold along a diagonal spiral line due to the compressive stresses. It is this stress that tends to squeeze all of the air from the tire 12.

Figure 5:
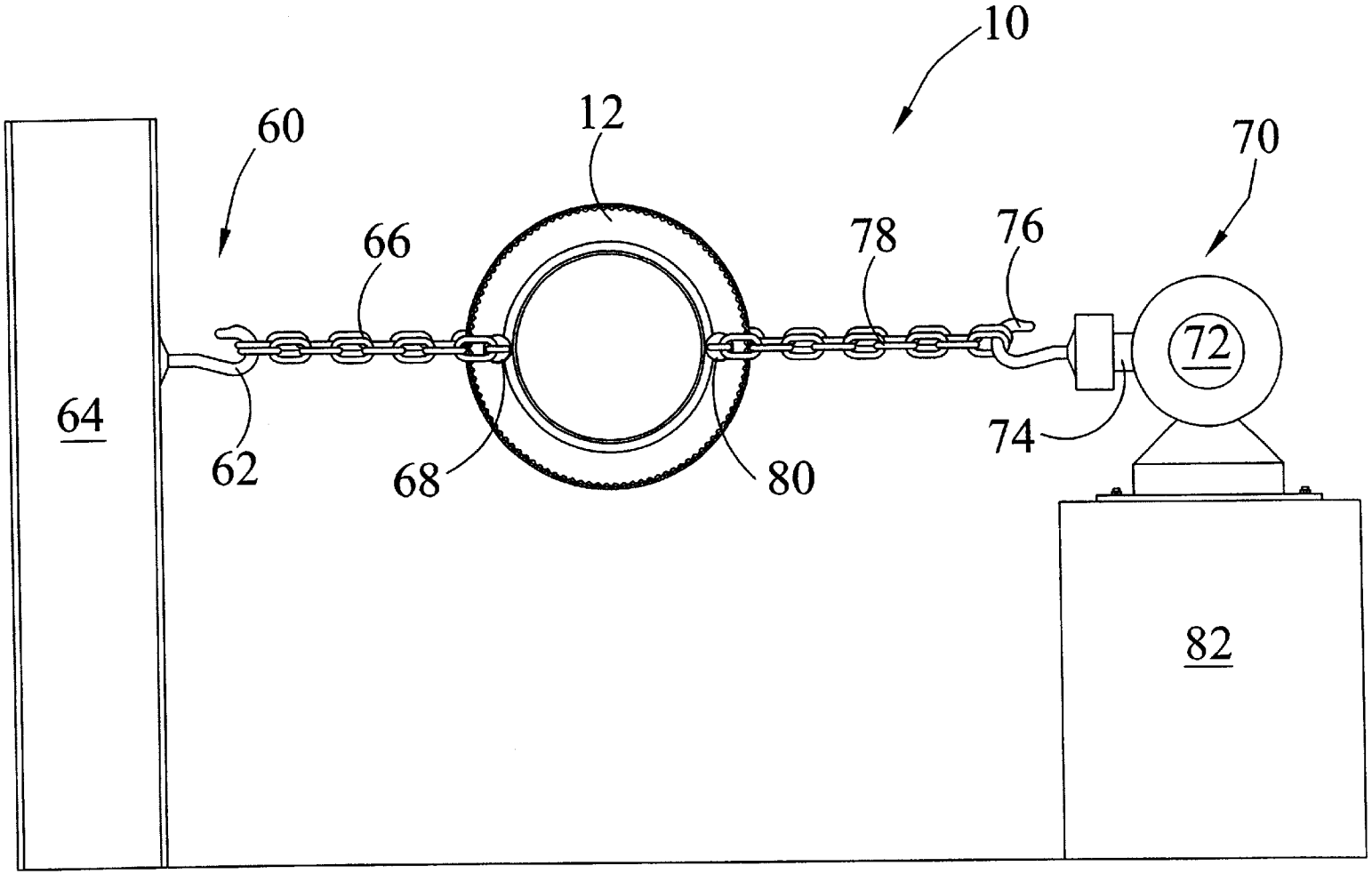
FIG. 5 is a side elevational view of a second embodiment of the tire compacting apparatus of the present invention.
Figure 6:
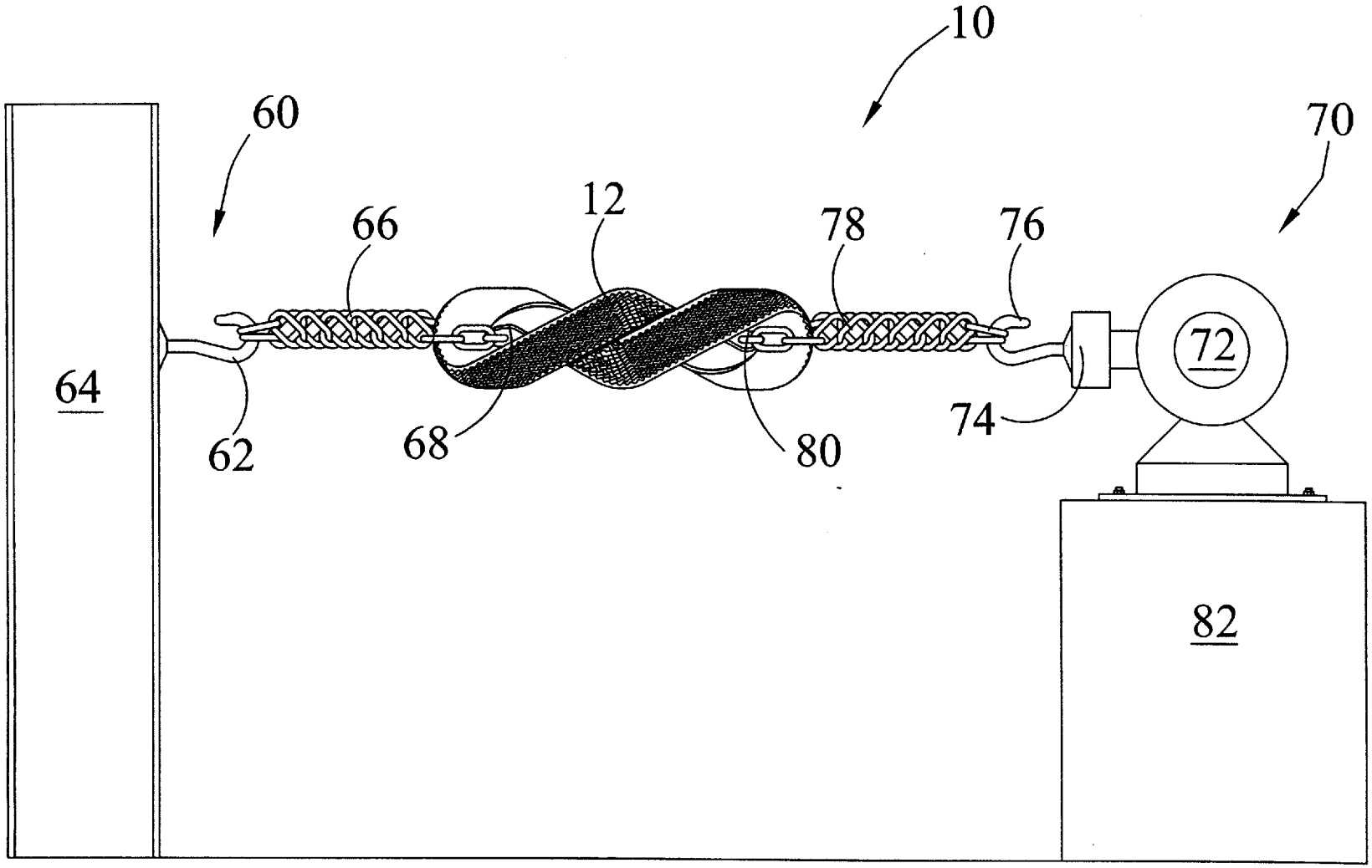
FIG. 6 is a side elevational view of the tire compacting apparatus as illustrated in FIG. 5, with the figure illustrating a twisted tire.
Figure 7:
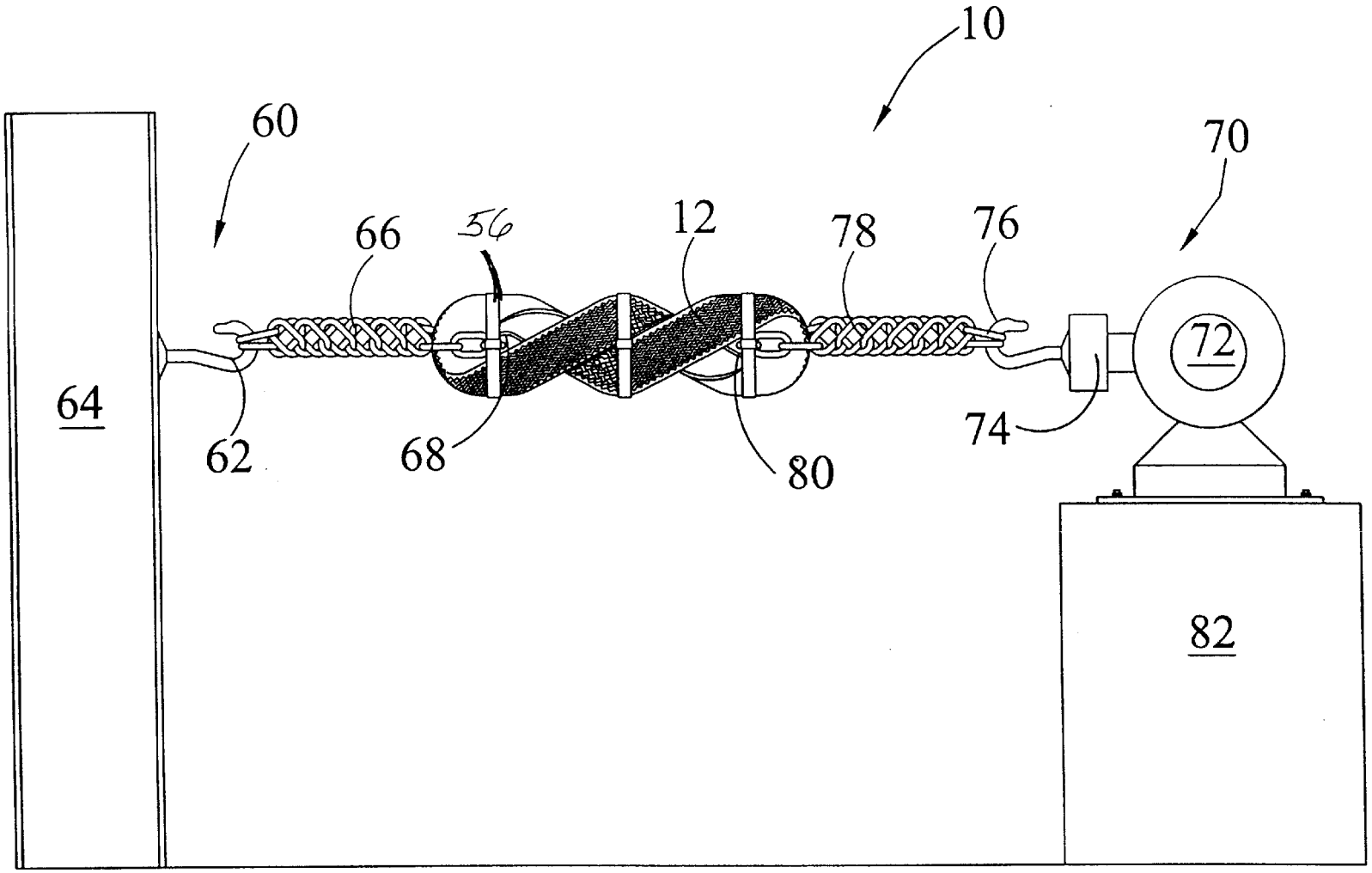
FIG. 7 is a side elevational view of the tire compacting apparatus as illustrated in FIG. 6, with the figure illustrating a twisted tire that is secured by locking belts.

Looking now to FIGS. 5 through 7, a second embodiment of the invention is provided. The tire compacting apparatus 10 of this second embodiment includes a stable holding member 60 and a rotating holding member 70, with the tire 12 being supported by both the stable holding member 60 and the rotating holding member 70.

Looking specifically to FIG. 5, the stable holding member 60 includes a substantially rigid arm 62 positioned on a resolute surface 64 or beam, such as a wall or a post, and a chain 66 that is connected to the rigid arm 62. The chain 66 therefore extends from the rigid arm 62 to engage the tire 12. The chain 66 may loop through the tire 12 and back to the rigid arm 62, or, looking to FIG. 5, a first mounting bracket 68 may be attached to each side of the tire 12 such that the chain 66 extends from the rigid arm 62 to be connected with the first mounting bracket 68.

Continuing to view FIG. 5, the rotating holding member 70 of the preferred embodiment includes a servomotor 72 having a rotatable shaft 74. A support arm 76 is connected to the rotatable shaft 74, with the support arm 76 preferably having the shape of a hook to engage a winding chain 78. The winding chain 78 preferably extends from the support arm 76 to traverse the center of the tire 12 and return to the support arm 76. Similar to the first mounting bracket 68 described above, a second mounting bracket 80 may be attached to the tire 12 such that the winding chain 78 extends from the support arm 76 to be connected with the second mounting bracket 80. Moreover, the rotating holding member 70 is preferably elevated by various means, such as by a platform 82 as shown in FIG. 5. Consequently, when the support chain 66 and the winding chain 78 engage the tire 12, the tire 12 will be above a ground or floor surface.

Looking to FIGS. 6 and 7, the second embodiment coils the tire 12 about a central axis much the same as the previous embodiment. Once the tire compacting apparatus 10 has provided the desired compaction, the user will be able to affix locking belts 56 around the edge of the tire 12, and then disconnect the support chain 66 and the winding chain 78 from the tire 12 for disposal of the tire 12.

Thus, although there have been described particular embodiments of the present invention of a new and useful TIRE COMPACTING APPARATUS AND METHOD OF EMPLOYING THE SAME, it is not intended that such references be construed as limitations upon the scope of this invention except as set forth in the following claims.

What is claimed is:

1. An apparatus for compacting a tire comprising:

a tire rotating apparatus; and a tire gripping apparatus facing said tire rotating apparatus;

wherein the tire is connected between said tire rotating apparatus and said tire gripping apparatus; and wherein said tire rotating apparatus will rotate the tire while the tire gripping apparatus remains static.

2. The apparatus as described in claim 1 further comprising a frame having a proximal side and a distal side;

wherein said tire rotating apparatus is attached to said proximal side and said tire gripping apparatus is attached to said distal side.

3. The apparatus as described in claim 2 wherein said tire rotating apparatus further comprises:

drive means for rotating said tire, said drive means affixed to said proximal side of said frame; and proximal fastening means for connecting said drive means with the tire.

4. The apparatus as described in claim 3 wherein said proximal fastening means comprises a proximal tire clamp, wherein said proximal tire clamp is attached to said drive means.

5. The apparatus as described in claim 3 wherein said drive means comprises a servomotor having a drive shaft, wherein said proximal tire clamp is connected to said drive shaft.

6. The apparatus as described in claim 2 wherein said tire gripping apparatus comprises:

an actuator having a slidable rod, wherein said actuator is affixed to said distal side of said frame; and distal fastening means for connecting said slidable rod to the tire;

wherein said slidable rod extends from said actuator to engage the tire and retracts into said actuator to stretch the tire.

7. The apparatus as described in claim 6 wherein said distal fastening means comprises:

a distal tire clamp to engage the tire, said distal tire clamp connected to said slidable rod of said actuator.

8. The apparatus as described in claim 6 wherein said actuator is a hydraulic actuator.

9. The apparatus as described in claim 6 wherein said actuator is a pneumatic actuator.

10. A tire compacting apparatus for compacting a tire comprising:

a static clamp to engage the tire;

a rotatable clamp substantially in front of said static clamp to engage the tire; and drive means for rotating said clamp, said drive means connected to said rotatable clamp to turn said rotatable clamp and compress the tire.

11. The apparatus as described in claim 10 wherein said drive means comprises a servomotor having a drive shaft, wherein said rotatable clamp is connected to said drive shaft.

12. The tire compacting apparatus as described in claim 10 further comprising a frame having a proximal side and a distal side;

wherein said static clamp is attached to said distal side and said rotatable clamp is attached to said proximal side.

13. The tire compacting apparatus as described in claim 12 further comprising:

an actuator affixed to said distal side of said frame; and a piston slidably positioned in said actuator to move from a retracted position to an extended position, said piston having a cantilevered end extending from said piston;

wherein said static clamp is mounted to said cantilevered end of said piston and engages the tire when said piston is in said extended position.

14. The apparatus as described in claim 13 wherein said actuator is a hydraulic actuator.

15. The apparatus as described in claim 13 wherein said actuator is a pneumatic actuator.

16. A method for compacting a tire comprising the steps of:

a) engaging a first edge of the tire with a rotatable clamp;

b) engaging a second edge of the tire opposite the first edge of the tire with a static clamp;

c) steadfastly holding the first edge of the tire with said static clamp; and d) turning said rotating clamp to twist and compact the tire.

17. The method for compacting a tire as described in claim 16, wherein step b) further comprises the steps of:

providing an actuator having a piston slidably positioned in said actuator to move between a retracted position and an extended position, said piston having a cantilevered end extending away from said actuator;

connecting said static clamp to said cantilevered end of said piston; and extending said piston;

engaging the tire with said static clamp.

18. The method for compacting a tire as described in claim 17 further comprising the steps of:

retracting said piston; and stretching the tire.

19. The method for compacting a tire as described in claim 16 wherein step d) further comprises the step of:

providing a motor having a drive shaft;

connecting said rotating clamp to said drive shaft;

engaging the second edge of the tire with said rotating clamp; and rotating said drive shaft and said rotating clamp.

20. The method for compacting a tire as described in claim 16 further comprising the step of:

fastening a locking belt around the compacted tire to secure the compacted position of the tire.

* * * * *